US005243944A

United States Patent [19]

Blumenstock

[11] Patent Number: 5,243,944

[45] Date of Patent: Sep. 14, 1993

[54] TANK-VENTING APPARATUS AS WELL AS A METHOD AND AN ARRANGEMENT FOR CHECKING THE OPERABILITY THEREOF

[75] Inventor: Andreas Blumenstock, Ludwigsburg, Fed. Rep. of Germany

[73] Assignee: Robert Bosch GmbH, Stuttgart, Fed. Rep. of Germany

[21] Appl. No.: 905,728

[22] Filed: Jun. 29, 1992

[30] Foreign Application Priority Data

Jun. 28, 1991 [DE] Fed. Rep. of Germany ..... 4121371
Aug. 14, 1991 [DE] Fed. Rep. of Germany ..... 4126880

[51] Int. Cl.[5] ..... F02M 33/02
[52] U.S. Cl. ..... 123/520; 123/521
[58] Field of Search ..... 123/520, 519, 521, 516, 123/518, 198 D

[56] References Cited

U.S. PATENT DOCUMENTS

| | | | |
|---|---|---|---|
| 4,112,898 | 9/1978 | Takimoto | 123/521 |
| 4,962,744 | 10/1990 | Uranishi et al. . | |
| 5,072,712 | 12/1991 | Steinbrenner | 123/520 |
| 5,088,466 | 2/1992 | Tada | 123/520 |
| 5,099,439 | 3/1992 | Saito | 123/520 |
| 5,113,834 | 5/1992 | Aramaki | 123/520 |
| 5,139,001 | 8/1992 | Tada | 123/520 |
| 5,150,689 | 9/1992 | Yano | 123/520 |

FOREIGN PATENT DOCUMENTS

| | | | |
|---|---|---|---|
| 0185966 | 10/1983 | Japan | 123/520 |
| 4-066764 | 3/1992 | Japan | 123/519 |

*Primary Examiner*—Carl S. Miller
*Attorney, Agent, or Firm*—Walter Ottesen

[57] ABSTRACT

The invention is directed to a method of checking the operability of a tank-venting apparatus for a motor vehicle having a fuel tank and an internal combustion engine including an air intake pipe. The method includes the steps of: measuring the temperature of the adsorption material with a first temperature sensor before the first regeneration of the adsorption material after a tanking operation; measuring the temperature of the adsorption material at a pregiven time point after the start of the first regeneration; forming the material temperature difference between the first and second measured values ($\theta 1_V - \theta 1_N$); measuring the temperature of the venting air close to the adsorption material with a second temperature sensor in advance of the first regeneration; measuring the temperature of the venting air at a pregiven time point after the start of the first regeneration; forming the venting-air temperature difference between the second and first measured values ($\theta 2_N - \theta 2_N$); subtracting the venting-air temperature difference from the material temperature difference to obtain a regeneration temperature difference; comparing the regeneration temperature difference to a threshold value; and, evaluating the apparatus as operational when the regeneration temperature difference exceeds the threshold value and, if not, then evaluating the apparatus as being inoperable. This method affords the advantage that temperature effects no longer constitute a disturbance when checking temperature changes of the adsorption material by means of regeneration operations with the temperature effects being caused by the venting air.

5 Claims, 3 Drawing Sheets

TANK-VENTING APPARATUS AS WELL AS A METHOD AND AN ARRANGEMENT FOR CHECKING THE OPERABILITY THEREOF

FIELD OF THE INVENTION

The invention is directed to a tank-venting apparatus for a motor vehicle having an internal combustion engine as well as a method and an arrangement for checking the tightness of the apparatus.

BACKGROUND OF THE INVENTION

A tank-venting apparatus is disclosed in U.S. Pat. No. 4,962,744. This tank-venting apparatus includes the features of: an adsorption filter having a connecting line from the intake end of the filter to the intake pipe of the internal combustion engine with a supply line to the tank and with a venting opening; a tank-venting valve which is connected into the connecting line; a temperature sensor in the adsorption material for measuring temperature changes thereof based on adsorption or desorption; and, a control arrangement for controlling the tank-venting valve and for evaluating the signals of the temperature sensor.

A method for checking the operability of the tank-venting apparatus configured as described above includes the following steps: measuring the temperature of the adsorption material at the beginning of a tanking operation; measuring the temperature of the adsorption material at the end of the tanking operation; forming the adsorption-temperature difference between the first and second measured values; comparing the adsorption-temperature difference with a threshold value; and, determining that portion of the apparatus between the tank and the adsorption filter as operable when the adsorption temperature difference exceeds a threshold value.

According to another embodiment of the invention, the method includes the steps of: measuring the temperature of the adsorption material before the first regeneration of the material after a tanking operation; measuring the temperature of the adsorption material at a pregiven time point after start of the first regeneration; forming the material temperature difference between the first and second measured values; and, deciding that the apparatus is operable when the material temperature difference exceeds a second threshold value.

The arrangement corresponding to the above methods for checking the operability of the tank-venting apparatus described initially includes a control arrangement which is so configured that this arrangement carries out the above-mentioned method steps.

SUMMARY OF THE INVENTION

Experiments have established that results with reference to the operability of the tank-venting apparatus have been partially inadequate with the above-mentioned method steps. It is therefore an object of the invention to provide a tank-venting apparatus configured in a similar way for which the operability can be more reliably checked as well as to provide a method and an arrangement for checking the operability of such an improved apparatus.

The tank-venting apparatus according to the invention includes the features of the apparatus described above and further includes a second temperature sensor which is mounted near the venting opening of the adsorption filter and is connected with the control unit.

The invention is based on the realization that temperature changes of the adsorption material are not only caused by adsorption or desorption of fuel vapor but also by a flow of venting air having a temperature which differs from the temperature of the adsorption material. With the second temperature sensor, it is possible to detect the temperature effect of the venting air and the detected effect is used to compensate for that portion of the temperature change of the adsorption material which is caused by the venting air.

The above-mentioned compensation can be undertaken in various ways. The preferred way is pursuant to the method of the invention wherein the above-described steps are carried out together with the regeneration of the material and by the following additional steps: measuring the temperature of the venting air before the first regeneration of the material after a tanking operation; measuring the temperature of the venting air at a pregiven time point after the start of the first regeneration; forming the venting-air temperature difference between the second and first measured values; subtracting the venting-air temperature difference from the material temperature difference to obtain a regeneration temperature difference; comparing the regeneration temperature difference with a threshold value; and, determining the apparatus as operable when the regeneration temperature difference exceeds the threshold value, otherwise, determining the apparatus as inoperable.

The ability of localizing errors is increased when a tank-venting apparatus is utilized which includes the above-mentioned configuration with a second temperature sensor near the venting opening of the adsorption filter and which additionally includes a third temperature sensor which is so mounted that it measures the temperature of the vapor flowing in the supply line and is connected to the control unit.

With a tank-venting apparatus of the invention, a method can be carried out which includes the steps of the known method described above in combination with the adsorption and which is characterized by the following further steps in combination with the regeneration: measuring the temperature of the vapor in the supply line at the start of a tanking operation; measuring the temperature of the vapor in the supply line at the end of the tanking operation; forming the vapor temperature difference between the first and second measured values; forming a modified adsorption temperature difference as the sum of the adsorption temperature difference and the vapor temperature difference; comparing the modified adsorption temperature difference with a threshold value; and, determining the portion of the apparatus between the tank and the adsorption filter as being operable when the modified adsorption temperature difference exceeds the threshold value, otherwise, determining the portion of the apparatus as inoperable.

The arrangement of the invention for checking the operability of the tank-venting apparatus includes a control arrangement which is so configured that it carries out the above method steps. In practice, the arrangement of the invention is realized by an appropriately programmed microcomputer.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
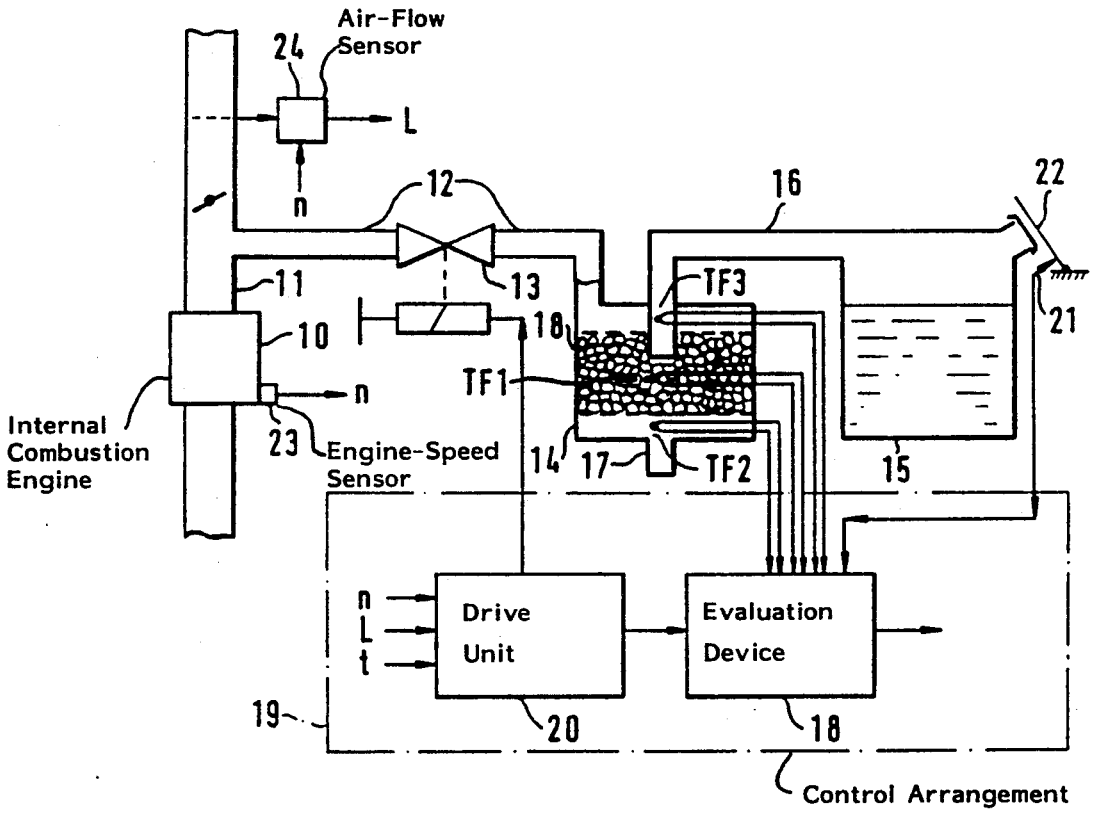
FIG. 1 is a schematic of an internal combustion engine having a tank-venting apparatus and includes a block diagram of a control arrangement for checking the operability of the tank-venting apparatus.

The tank-venting apparatus shown in FIG. 1 is arranged on an internal combustion engine 10 having an intake pipe 11. The tank-venting apparatus includes a connecting line 12 having a tank-venting valve 13 connected therein between the intake pipe 11 and an adsorption filter 14 as well as a supply line 16 leading from the filter 14 to a tank 15. In the lower portion of the adsorption filter 14, a venting line 17 communicates with the filter at its venting end.

Three temperature sensors TF1, TF2 and TF3 are mounted on the adsorption filter 14. The first temperature sensor TF1 measures the temperature of the adsorption material 18 close to the opening of the supply line 16. The temperature sensor TF2 measures the temperature of the venting air close to the adsorption material with the venting air flowing in via the venting line 17. The third temperature sensor TF3 measures the temperature of the vapor in the supply line 16 likewise close to the adsorption material. The three temperature sensors are connected to an evaluation device 18 within a control arrangement 19. A signal from a drive unit 20 for the tank-venting valve 13 is supplied to this evaluation device 18 and is likewise accommodated within the control arrangement 19. Finally, the evaluation device 18 receives a signal from a tank-closure sensor 21 which monitors when the tank closure 22 is opened and closed.

Operating parameters of the engine 10, which are of interest in combination with the function of the tank-venting apparatus, include especially the engine speed (n), which is detected by an engine-speed sensor 23 on the engine, and the air mass flowing through the intake pipe 11, which is detected by an air-flow sensor 24. By dividing the air-mass signal by the engine speed, a signal is obtained which is a measure for the so-called load L of the engine. The throughput, which the tank-venting valve 13 may have, is determined in dependence upon the load and engine speed and can be appropriately driven by the drive unit 20. Preferably, the tank-venting apparatus is so operated that phases wherein a throughput passes through the tank-venting valve alternate with phases wherein the tank-venting valve is completely shut. In order to determine these phases, the drive unit 20 receives still a further signal which is a measure for the time (t). Whether a phase change of this kind takes place or not is however unimportant for the method embodiments described below.

Figure 2:
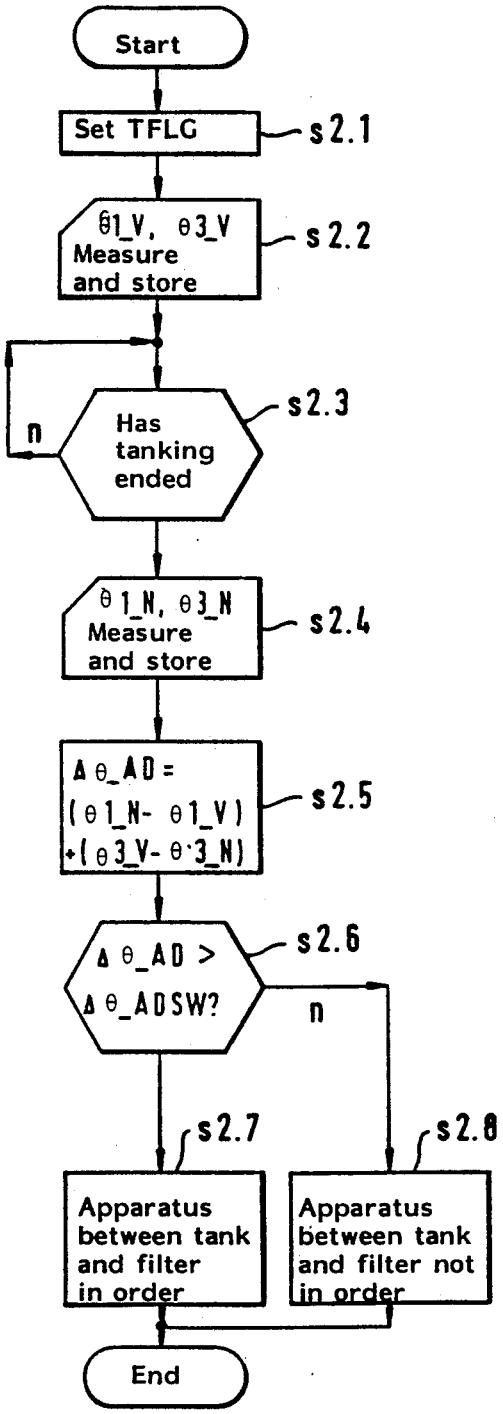
FIG. 2 is a flowchart for explaining an embodiment of the method of the invention with which the operability of the portion of the tank-venting apparatus between the tank and the adsorption filter can be checked.

According to FIG. 2, the method for determining the operability of the portion of the apparatus between the tank 15 and the adsorption filter 17 begins when the tank-closure sensor 21 determines that the tank closure 22 is being opened. A flag TFLG is then set in step s2.1 which indicates that a tanking operation is taking place. The temperatures $\theta 1_V$ and $\theta 3_V$ are then measured (step s2.2) by the temperature sensors TF1 and TF3 and stored. Then, in step s2.3, time is allowed to pass until the tank closure 22 is again closed. Thereafter, in step s2.4, the temperatures are again measured by both of the above-mentioned sensors and stored as $\theta 1_N$ and $\theta 3_N$, respectively. The four mentioned temperatures are used to determine a modified adsorption temperature difference $\Delta\theta_AD$. This is a temperature increase having a magnitude of several 10° C. as caused by the heat which is released because of the adsorption of fuel vapor on the active charcoal. A precondition for this condition is that the vapor flowing into the adsorption filter is not considerably cooler than the adsorption material 18. The last-mentioned case can occur when the adsorption filter 17 is mounted in the engine compartment of a motor vehicle which was driven at high ambient temperatures and when the tank is then filled with relatively cool fuel. When such a case occurs, the assumption is made that the cooling by the fuel vapor just compensates for the increased warming by the adsorption and no temperature increase in the adsorption filter is determined by the first temperature sensor TF1. However, the third temperature sensor TF3 then indicates the drop of the temperature of the fuel vapor in the end region of the supply line 16, which is at first relatively high, to a low value during tanking. In order to be able to decide in all cases whether adsorption heat has occurred, the modified adsorption temperature difference $\Delta\theta_AD$ is computed as given by the equation in the block of step s2.5 in FIG. 2.

If this temperature difference is above a threshold value $\Delta\theta_ADSW$, which is checked in step s2.6, then in step s2.7, the determination is made that the tank-venting apparatus is operable between the tank and the adsorption filter. Otherwise, the determination is made in step s2.8 that the above-mentioned portion of the apparatus is inoperable.

Figure 3:
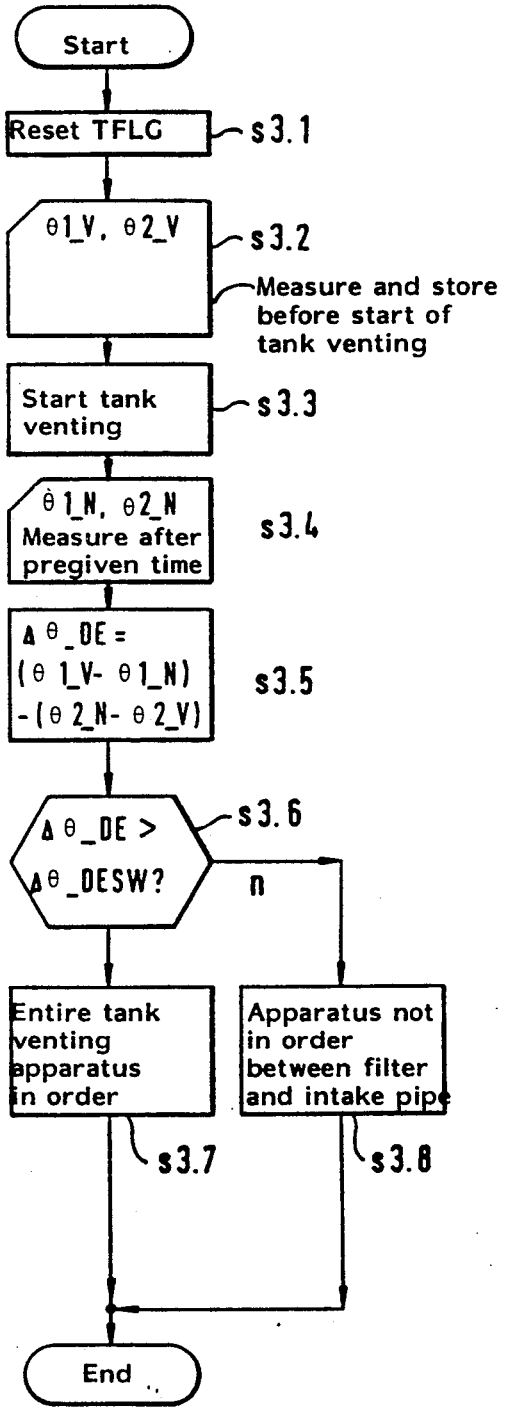
FIG. 3 is a flowchart for explaining another embodiment of the invention with which the tank-venting apparatus portion between the adsorption filter and the intake pipe can be checked; and, FIGS. 4*a* and 4*b* are flowcharts for explaining a two-stage method for checking the operability of a tank-venting apparatus according to FIG. 1 but without the third temperature sensor TF3 shown there.

The method of FIG. 3 is only carried out when the method sequence of FIG. 2 determines that the tank-venting apparatus between the tank and the adsorption filter is in order. A sequence is run through only once and only starting at that instant when the first tank-venting phase is begun after tanking. That this condition is satisfied can be checked with the aid of the tanking flag TFLG set in step s2.1.

As soon as the above-mentioned conditions are all satisfied, the method of FIG. 3 is started wherein first the tanking flag TFLG is reset (step s3.1). The temperatures $\theta 1_V$ and $\theta 2_V$ are detected by the first and second temperature sensors TF1 and TF2, respectively, in step s3.2 before starting the tank-venting phase. The tank-venting phase is then started (step s3.3). After a pregiven time span has passed after the start of the tank-venting phase, the temperatures are again measured by the above-mentioned temperature sensors as $\theta 1_N$ and $\theta 2_N$, respectively (step s3.4). All measured temperatures are also stored in this method sequence so that they are available for computing a temperature difference with this temperature difference being a regeneration temperature difference $\Delta\theta_DE$. This takes place with the equation shown in the block of step s3.5 (FIG. 3). This equation considers a similar possible heat quantity compensation effect as explained further above in connection with step s2.5.

When regenerating the adsorption filter, that is when desorption of fuel is necessary from the adsorption material 18, heat is needed which leads to a temperature drop in the adsorption material. This effect is then compensated by the relatively warm inflowing venting air. A compensation of this kind can however be detected in that the temperature sensor TF2 announces a lower temperature in advance of the regeneration than thereafter during the regeneration operation. The equation in step s3.5 is so structured that it shows in any event a regenerated temperature difference when regeneration actually takes place independently of whether the temperature of the adsorption material 18 is actually lowered or whether this temperature remains essentially the same because of the warming effect of the venting air.

When the regeneration temperature difference exceeds a threshold value $\Delta\theta$_DESW which is checked in step s3.6, this means that tank-venting apparatus is in order (step s3.7). Otherwise, the tank-venting apparatus is defective between the adsorption filter and the intake pipe (step s3.8).

The overall method described up to now is dependent upon a tank-venting apparatus which has three temperature sensors TF1 to TF3. Because of these temperature sensors, the method can localize occurring defects with relative precision. If the temperature sensor TF3 is omitted, then it is still possible to check the operability of the overall apparatus and to detect the defective portion with a relatively large probability. A two-step sequence for this purpose will now be explained with reference to FIGS. 4*a* and 4*b*.

Figure 4A:
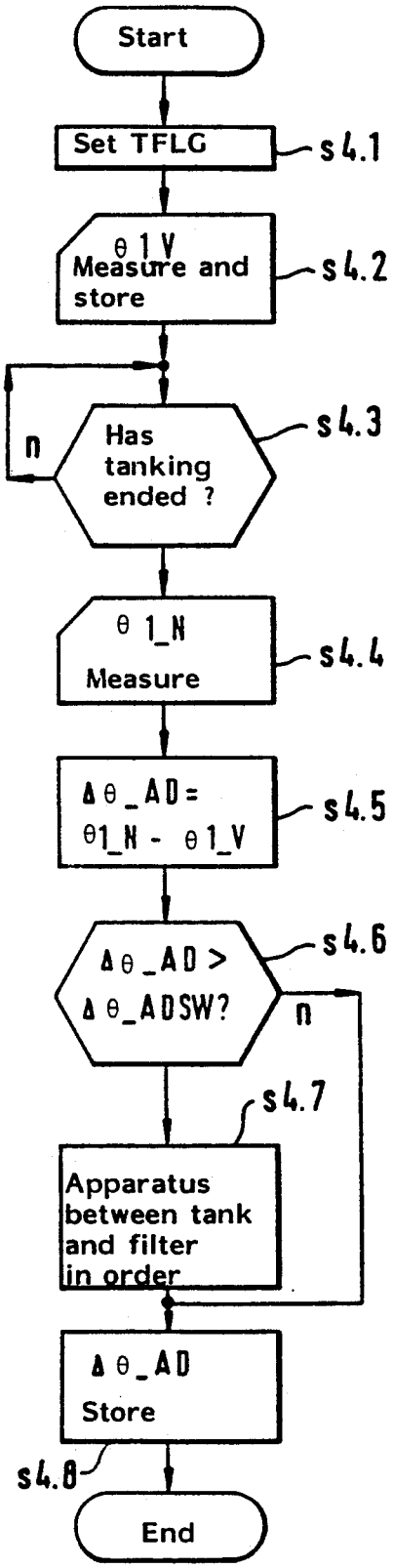

The method of FIG. 4*a* starts under the same condition as the method of FIG. 2 and first (step s4.1) a venting flag TFLG is set. Steps s4.2 to s4.4 then are run through which correspond to steps s2.2 to s2.4, respectively, but wherein the temperature of the third temperature sensor TF3 is no longer detected as the third temperature sensor is omitted. Accordingly, the second correction term present in the block of step s2.5 is omitted in the following step s4.5 for computing an adsorption temperature difference $\Delta\theta$_AD. The above-mentioned temperature difference is only obtained in that the value $\theta$1_V is subtracted from value $\theta$1_N. The following steps s4.6 and s4.7 are identical to steps s2.6 and s2.7, respectively. Step s4.8 is new in which the temperature difference $\Delta\theta$_AD is stored in order to be available in the second method step of FIG. 4*b*. Starting from the decision step s4.6, the step s4.8 is reached either directly, namely, then, when the temperature difference does not exceed the above-mentioned threshold value, or otherwise, the step s4.8 is reached via the above-mentioned step s4.7. The first method step of FIG. 4*a* ends after storage of the above-mentioned temperature difference.

Figure 4B:
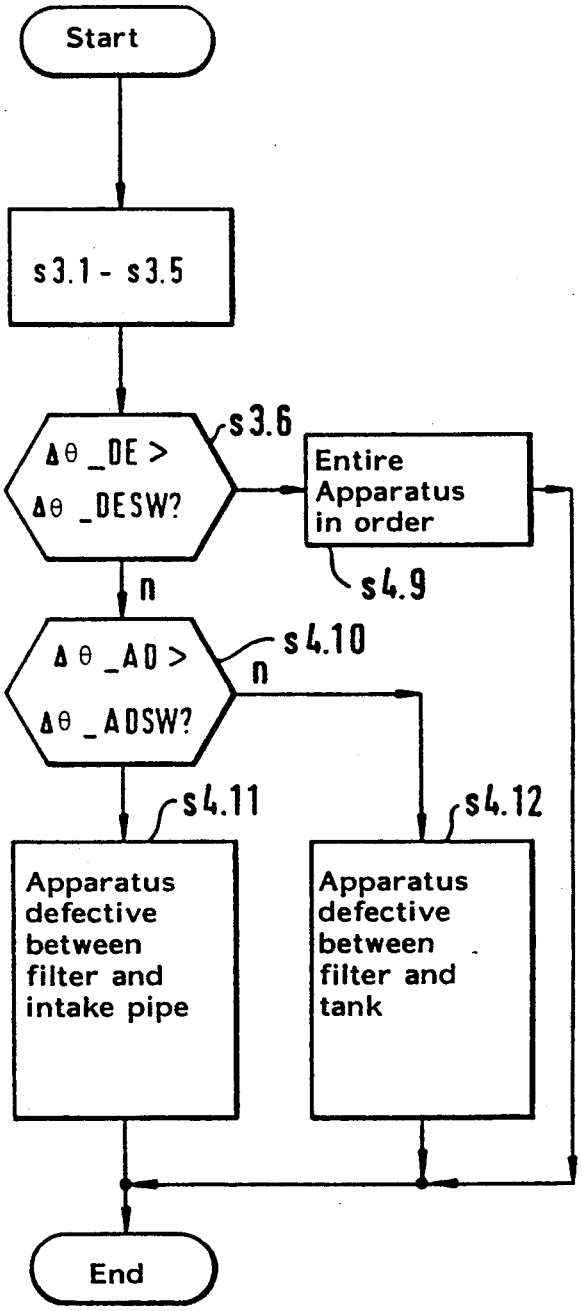

The second method step of FIG. 4*b* is started with one less condition than the method of FIG. 3. It is then not a condition precedent that the apparatus is in order between the tank and the adsorption filter. This is the case since in the sequence part of FIG. 4*a*, no clear decision as to the operability of the apparatus can be made. The case described further above of cooling of the adsorption material by a relatively cool vapor from the tank is present with the consequence that, notwithstanding an orderly adsorption, no significant temperature increase of the adsorption material is measured. Viewed from the sequence, it is then unclear whether the above-mentioned compensation is present or whether no adsorption took place. Accordingly, the second method step of FIG. 4*b* must in any event be carried out as soon as the operating state of the engine permits. In contrast, the method of FIG. 3 can be omitted when a clear decision has been made from FIG. 2 that the tank-venting apparatus is not operable.

As soon as the submethod of FIG. 4*b* is started, the already described steps s3.1 to s3.6 are run through. If it is determined in step s3.6 that the value of $\Delta\theta$_DE exceeds the threshold value $\Delta\theta$_DESW, the apparatus is determined as being operable (step s4.9). Otherwise, the apparatus is undoubtedly defective; however, the result makes possible that a decision can be made from the first submethod of FIG. 4*a* in which portion of the apparatus the defect is. For this purpose, a check (step s4.10) is made as to whether the adsorption temperature difference $\Delta\theta$_AD stored in step s4.8 exceeds a threshold value $\Delta\theta$_DASW. If this is the case, then it is detected (step s4.11) that the apparatus is defective between the adsorption filter and the intake pipe. This is the case because step s3.6 in the sequence of FIG. 4*b* has generally announced a defect; however, from step s4.10, results show that the defect does not lie between the tank and the adsorption filter. However, if it is determined in step s4.10, that the above-mentioned threshold has not been exceeded, it is determined (step s4.12) that the apparatus is defective and probably between the tank and the adsorption filter. This is the case because the compensation effect described further above has only a slight probability during adsorption so that a low temperature difference measured during adsorption is a serious indication as to a defect of the apparatus between the tank and the adsorption filter. If such a defect is actually present, then no temperature reduction is determined in step s3.6 of FIG. 4*b* since no fuel is present for regeneration in the adsorption filter.

With the temperatures measured by the three temperature sensors TF1 to TF3, other method sequences can be carried out than those described above. Especially, the investigations can be coupled to other conditions which occur than the tanking of the motor vehicle and the first tank-venting phase thereafter after starting of the vehicle. However, the satisfaction of these conditions has as a consequence especially significant measuring effects.

As to the arrangement of the temperature sensors, it is noted that these sensors are best so mounted that the first temperature sensor TF1 measures the temperature of the adsorption material 18 close to the opening of the supply line 16 and that the temperature sensor TF2 measures the temperature of the venting air close to the adsorption material 18 and the third temperature sensor TF3 measures the temperature of the vapor in the supply line 16 as close as possible forward of the entrance of the vapor into the adsorption material 18.

A tank-venting apparatus is especially advantageous which has only the first and second temperature sensors TF1 and TF2. The same reliability as to the data for operability is obtained as with three temperature sensors having only a slightly lesser reliability as to the data with respect to localizing the defect.

It is understood that the foregoing description is that of the preferred embodiments of the invention and that various changes and modifications may be made thereto without departing from the spirit and scope of the invention as defined in the appended claims.

What is claimed is:

1. A tank-venting apparatus for an internal combustion engine having an intake pipe and being equipped with a fuel tank, the tank-venting apparatus comprising:

an adsorption filter having a suction end and containing adsorption material;

said adsorption filter further having a venting opening;

a connecting line connecting said suction end to said intake pipe;

a supply line connecting said fuel tank to said adsorption filter for conducting fuel vapor to said adsorption filter;

a tank-venting valve connected into said connecting line;

a first temperature sensor emitting a first signal and being mounted in said adsorption material for measuring temperature changes thereof because of adsorption and desorption;

a control arrangement for controlling said tank-venting valve and for evaluating the operability of said tank-venting apparatus by evaluating said first signal;

a second temperature sensor mounted close to said venting opening and being connected to said control arrangement;

a third temperature sensor mounted so as to measure the temperature of said fuel vapor in the region of said adsorption filter; and, said third temperature sensor being connected to said control arrangement.

2. A method of checking the operability of a tank-venting apparatus for a motor vehicle having a fuel tank and an internal combustion engine including an air intake pipe, the tank-venting apparatus including an adsorption filter containing adsorption material and having a venting opening, a supply line interconnecting the adsorption filter and the fuel tank, a connecting line interconnecting the adsorption filter and the intake pipe, and a tank-venting valve mounted in the connecting line between the adsorption filter and the intake pipe, the method comprising the steps of:

measuring the temperature of said adsorption material with a first temperature sensor before the first regeneration of said adsorption material after a tanking operation;

measuring the temperature of said adsorption material at a pregiven time point after the start of said first regeneration;

forming the material temperature difference between the first and second measured values ($\theta 1_V - \theta 1_N$);

measuring the temperature of the venting air with a second temperature sensor in advance of said first regeneration;

measuring the temperature of the venting air at a pregiven time point after the start of said first regeneration;

forming the venting-air temperature difference between the second and first measured values ($\theta 2_N - \theta 2_V$);

subtracting the venting-air temperature difference from the material temperature difference to obtain a regeneration temperature difference;

comparing the regeneration temperature difference to a threshold value; and, evaluating the apparatus as operational when said regeneration temperature difference exceeds the threshold value and, if not, then evaluating said apparatus as being inoperable.

3. The method of claim 2, further comprising the steps of:

measuring the temperature of the adsorption material at the start of a tanking operation;

measuring the temperature of the adsorption material at the end of the tanking operation;

forming the adsorption temperature difference between the second and first measured values ($\theta 1_N - \theta 1_V$);

comparing the adsorption temperature difference with a threshold value; and, evaluating the portion of the apparatus between said tank and said adsorption filter as operable when the adsorption temperature difference exceeds the threshold value.

4. The method of claim 3, further comprising the steps of:

measuring the temperature of the vapor in said supply line in the region of said adsorption filter with a third temperature sensor at the start of a tanking operation;

measuring the temperature of the vapor in said supply line at the end of the tanking operation;

forming the vapor temperature difference between the first and second measured values ($\theta 3_V - \theta 3_N$);

comparing the modified adsorption temperature difference to a threshold value; and, evaluating the portion of said apparatus between said tank and said adsorption filter as operable when the modified adsorption temperature difference exceeds the threshold value, and, if not, then evaluating said apparatus as being inoperable.

5. An arrangement for checking the operability of a tank-venting apparatus for a motor vehicle equipped with a fuel tank and an internal combustion engine having an intake pipe and a tank-venting apparatus, the tank-venting apparatus including an adsorption filter containing adsorption material and having a venting opening through which venting air flows, a supply line interconnecting the adsorption filter and the fuel tank, a connecting line interconnecting the adsorption filter and the intake pipe, a tank-venting valve mounted in the connecting line between the adsorption filter and the intake pipe, and a temperature sensor for measuring the temperature of the adsorption material, said arrangement comprising:

a control arrangement including: means for utilizing said temperature sensor for measuring the temperature of the adsorption material before the first regeneration of the material after a tanking operation; means for utilizing said temperature sensor for measuring the temperature of the adsorption material at a pregiven time point after the start of said first regeneration; and, means for forming the material temperature difference between the first and second measured values ($\theta 1_V - \theta 1_N$);

a second temperature sensor for measuring the temperature of said venting air;

said control arrangement further including: means for utilizing said second temperature sensor for measuring the temperature of the venting air before said first regeneration;

means for utilizing said second temperature sensor for measuring the temperature of the venting air at a pregiven time point after the start of said first regeneration;

means for forming the venting-air difference between the second and first measured values ($\theta 2_N - \theta 2_V$);

means for subtracting the venting air temperature difference from the material temperature difference to obtain a regeneration temperature difference;

comparison means for comparing said regeneration temperature difference to a threshold value; and, evaluation means for evaluating said tank-venting apparatus as operable when said regeneration temperature difference exceeds said threshold value and, if not, then evaluating said tank-venting apparatus as being inoperable.

* * * * *